US006568492B2

(12) United States Patent
Thigpen et al.

(10) Patent No.: US 6,568,492 B2
(45) Date of Patent: May 27, 2003

(54) DRAG-TYPE CASING MILL/DRILL BIT

(75) Inventors: Gary M. Thigpen, Kingwood, TX (US); Carl W. Keith, Houston, TX (US)

(73) Assignee: Varel International, Inc., Carrollton, TX (US)

( * ) Notice: Subject to any disclaimer, the term of this patent is extended or adjusted under 35 U.S.C. 154(b) by 48 days.

(21) Appl. No.: 09/798,171

(22) Filed: Mar. 2, 2001

(65) Prior Publication Data

US 2002/0121393 A1 Sep. 5, 2002

(51) Int. Cl.[7] ..... E21B 7/08; E21B 10/46

(52) U.S. Cl. ..... 175/408; 175/434

(58) Field of Search ..... 175/408, 425, 175/426, 434, 435, 432, 61

(56) References Cited

U.S. PATENT DOCUMENTS

| | | | | |
|---|---|---|---|---|
| 2,371,490 | A | 3/1945 | Williams, Jr. | 255/61 |
| 3,058,535 | A | 10/1962 | Williams, Jr. | 175/330 |
| 3,153,458 | A | 10/1964 | Short | 175/329 |
| 3,709,308 | A | 1/1973 | Rowley et al. | 175/329 |
| 3,938,599 | A | 2/1976 | Horn | 175/329 |
| 4,109,737 | A | 8/1978 | Bovenkerk | 175/329 |
| 4,351,401 | A | 9/1982 | Fielder et al. | 175/329 |
| 4,386,669 | A | 6/1983 | Evans | 175/269 |
| 4,499,958 | A | 2/1985 | Radtke et al. | 175/329 |
| 4,554,986 | A | 11/1985 | Jones | 175/397 |
| 4,718,505 | A | 1/1988 | Fuller | 175/329 |
| 4,763,737 | A | 8/1988 | Hellnick | 175/393 |
| 4,889,017 | A | 12/1989 | Fuller et al. | 76/108 A |
| 4,981,184 | A | 1/1991 | Knowlton et al. | 175/329 |
| 4,982,802 | A | 1/1991 | Warren et al. | 175/57 |
| 4,991,670 | A | 2/1991 | Fuller et al. | 175/329 |
| 5,010,789 | A | 4/1991 | Brett et al. | 76/108.2 |
| 5,042,596 | A | 8/1991 | Brett et al. | 175/57 |
| 5,090,492 | A | 2/1992 | Keith | 175/410 |
| 5,111,892 | A | 5/1992 | Sinor et al. | 175/65 |
| 5,131,478 | A | 7/1992 | Brett et al. | 175/57 |
| 5,199,511 | A | 4/1993 | Tibbitts et al. | 175/65 |
| 5,244,039 | A | 9/1993 | Newton, Jr. et al. | 175/431 |

(List continued on next page.)

FOREIGN PATENT DOCUMENTS

| | | | | |
|---|---|---|---|---|
| EP | 0 169 683 A2 | 1/1986 | | E21B/10/46 |
| EP | 0916803 A2 * | 5/1999 | | E21B/10/46 |
| GB | 2 273 946 A | 7/1994 | | E21B/10/46 |
| GB | 2 326 659 A | 12/1998 | | E21B/10/46 |
| GB | 2353 548 A | 2/2001 | | E21B/10/46 |

OTHER PUBLICATIONS

Childers, Ronald D., et al, "*PCD Technology Advances Sidetracking Capabilities*", IADC/SPE 59185 Paper, Technical Paper prepared for presentation at the 2000 IADC/SPE Drilling Conference, New Orleans, LA, Feb. 23–25, 2000, 11 pages.

DPI Product Bulletin, "*DPI Shaped Cutters and Reverse Bullets*", Product Bulletin No. 001, issued Nov. 9, 1995, Revision 1, pp. 1–7.

(List continued on next page.)

*Primary Examiner*—David Bagnell
*Assistant Examiner*—T. Shane Bomar

(57) ABSTRACT

A drag type casing mill/drill bit for down hole milling of a casing window and lateral drilling of a bore hole in an earth formation comprises a bit body adapted to be rotated in a defined direction. The bit body includes an operating end face having a plurality of radially extending blades formed as a part of the operating end face of the bit body. A plurality of primary cutting elements are individually mounted in pockets in one of the plurality of blades. In addition, a plurality of secondary ridge structures are mounted to each of the plurality of blades interspersed with the plurality of primary cutting elements in a pattern such that as the bit body rotates the secondary ridge structures contact the casing or the earth formation thereby protecting the primary cutting elements and allowing continuous substantially smooth casing milling and earth formation drilling.

29 Claims, 3 Drawing Sheets

U.S. PATENT DOCUMENTS

| | | | | | |
|---|---|---|---|---|---|
| 5,265,685 | A | | 11/1993 | Keith et al. | 175/431 |
| 5,303,785 | A | | 4/1994 | Duke | 175/57 |
| 5,314,033 | A | | 5/1994 | Tibbitts | 175/431 |
| 5,333,699 | A | * | 8/1994 | Thigpen et al. | 175/431 |
| 5,346,025 | A | | 9/1994 | Keith et al. | 175/57 |
| 5,551,509 | A | | 9/1996 | Braddick | 166/55.7 |
| 5,551,522 | A | | 9/1996 | Keith et al. | 175/420.2 |
| 5,558,170 | A | | 9/1996 | Thigpen et al. | 175/57 |
| 5,595,252 | A | | 1/1997 | O'Hanlon | 175/57 |
| 5,647,436 | A | | 7/1997 | Braddick | 166/298 |
| 5,657,820 | A | | 8/1997 | Bailey et al. | 166/55.7 |
| 5,678,645 | A | * | 10/1997 | Tibbitts et al. | 175/426 |
| 5,803,196 | A | | 9/1998 | Fielder | 175/431 |
| 5,873,422 | A | | 2/1999 | Hansen et al. | 175/399 |
| 5,887,668 | A | | 3/1999 | Haugen et al. | 175/79 |
| 5,904,213 | A | | 5/1999 | Caraway et al. | 175/393 |
| 5,908,071 | A | | 6/1999 | Hutchinson et al. | 166/55.6 |
| 5,944,101 | A | | 8/1999 | Hearn | 166/117.5 |
| 5,950,747 | A | | 9/1999 | Tibbitts et al. | 175/432 |
| 5,967,246 | A | * | 10/1999 | Caraway et al. | 175/393 |
| 5,967,247 | A | | 10/1999 | Pessier | 175/408 |
| 5,979,571 | A | * | 11/1999 | Scott et al. | 166/298 |
| 6,009,962 | A | | 1/2000 | Beaton | 175/426 |
| 6,039,131 | A | * | 3/2000 | Beaton | 175/376 |
| 6,068,072 | A | | 5/2000 | Besson et al. | 175/432 |
| 6,089,336 | A | | 7/2000 | Nexton et al. | 175/393 |
| 6,092,613 | A | | 7/2000 | Caraway et al. | 175/393 |
| 6,129,161 | A | | 10/2000 | Roberts et al. | 175/393 |
| 6,170,576 | B1 | | 1/2001 | Brunnert et al. | 166/298 |
| 6,298,930 | B1 | | 10/2001 | Sinor et al. | 175/428 |
| 2001/0030063 | A1 | | 10/2001 | Dykstra et al. | 175/57 |
| 2001/0035302 | A1 | | 11/2001 | Desai et al. | 175/61 |

OTHER PUBLICATIONS

Hughes Christensen, cover page of product bulletin WL/5MUS/5MA4/9–98 (1 page) and product description of Star Bits, pp. 36–37, Sep. 1998.

Geo Diamond, "*Technology in Motion*", brief company product overview of PDC drill bit, 1 page; 1996 Month of publication needed.

GeoDiamond, ER 535 product description for S94 Steel Body Bit, IADC Code S121, 1 page To be conformance, a publication date is required.

Hycalog, Hybrid PDC bit product description (1 page) and Hycalog drill bit "*Handbook Overview*", 1994 Month of publication needed.

Hycalog, BiCentrix™ Bits product pamphlet, 2 pages, 1996 Month of publication needed.

Dowdco, DP–384, IADC: M–233, Drill Bit product description and specification, 1 page To be in conformance, a publication date is required.

Technical Data, "*PDC Mill for Trackmaster*", Smith Drilling & Completiona, Document Reference No. TSD128, Rev. 'A', 4 pages, Apr. 22, 1999.

"*Trackmaster*", Service Office location brochure, Smith Services, Red Baron Group, 2 pages, Oct. 1999.

Smith Services, Red baron Group, "*Trackmaster™ Whipstock*", product brochure, 2 pages Date required for conformance, Unknown.

Smith Drilling & Completions, Trackmaster, product overview, 1 page Date required for conformance, Unknown.

Hughes Christensen Bit Drawing dated May 29, 1997—HC Part No. CC201918, 1 page.

Hughes Christensen Bit Drawing dated Sep. 18, 1996—HC Part No. CW210655, 1 page.

Hughes Christensen Bit Drawing dated Sep. 18, 1996—HC Part No. CS205023, 1 page.

Hughes Christensen Bit Drawing dated Sep. 9, 1996—HC Part No. CC201718, 1 page.

1995 Hughes Christensen 1995 Drill Bit Catalog, p. 31 Month needed.

* cited by examiner

DRAG-TYPE CASING MILL/DRILL BIT

TECHNICAL FIELD OF THE INVENTION

This invention relates to a combination mill/drill bit having primary cutting elements and secondary structures, and more particularly to a combination mill/drill bit comprising primary cutting elements and secondary structures to enable continuous substantially smooth milling of down hole casing and drilling of an earth formation.

BACKGROUND OF THE INVENTION

Heretofore, the milling of down hole casing and the drilling of an earth formation laterally from the casing were performed as two separate operations requiring tripping the mill tool before sidetrack drilling of laterals in the earth formation. Milling tools for casing have typically been made of crushed carbide to provide sufficient cutting ability for the varying hardness of steel casing. Typically, a mill tool would be retrieved after milling a window in the down hole casing and then discarded.

The manufacturing process used in making prior art milling tools provided no organization of the cutting structure; consequently, milling a window in a down hole casing became a lengthy and time consuming process. This is due to varying down hole conditions, operating parameters and applications. In many cases the quality of the manufacturing process for applying the cutting structure to a milling tool depended upon the skill of the person applying the cutting structure. Experience has shown that present milling tools if used after cutting a window in a down hole casing would not be effective in drilling a lateral bore in most earth formations. Thus the milling tool must be tripped out of the well, a time consuming and costly operation. After tripping out the milling tool a second tool, that is a drill bit, suited for drilling formations of the earth would be tripped into the well to proceed with the drilling portion of the operation.

Typically, the cutting element of an earth boring drill bit, although very wear resistant, could not survive the impacts of the interrupted cuts that occur during milling a window in steel casing. Thus the earth boring drill bit cannot be used for both the milling operation and the drilling operation. When drill bits designed for boring in various earth formations were used for milling a window in a casing, the result was usually catastrophic in that most of the cutting elements were broken primarily resulting from the impact loads as the cutting elements enter and leave the steel casing during the window milling operation.

As a result of varying down hole conditions, performance of present milling/drilling tools used to mill a casing window and then laterally drill through an earth formation produced varying results. To achieve some degree of uniformity required extensive control of manufacturing processes to ensure quality tools considered to be essential for consistent performance. The results have not always been encouraging and most operators prefer to trip the milling tool and run in the drill bit even though this was a time consuming and costly operation. Thus, there is a need for a mill/drill bit that will remain in the bore hole after window milling of the steel casing and continue with the drilling of laterals in the earth formation.

SUMMARY OF THE INVENTION

In accordance with the present invention there is provided a drag-type mill/drill bit for down hole milling of a window in casing and lateral drilling of an earth formation that comprises a bit body adapted to be rotated in a defined direction. The bit body has an operating end face with a plurality of primary cutting elements each mounted in a pocket in the operating end face of the bit body. In addition, a plurality of secondary ridge structures are mounted to the operating end face interspersed with the plurality of primary cutting elements in a pattern such that as the bit body rotates the secondary ridge structures contact the down hole casing or the earth formation thereby protecting the primary cutting elements and allowing continuous substantially smooth casing milling or earth formation drilling.

Also in accordance with the present invention there is provided a drag-type mill/drill bit for a down hole milling of a window in casing and lateral drilling of an earth formation comprising a bit body adapted to be rotated in a defined direction, the bit body having an operating end face. A plurality of radially extending blades are formed as a part of the operating end face of the drill bit and a plurality of primary cutting elements are mounted in pockets in the plurality of blades. A plurality of secondary ridge structures are also mounted to each of the plurality of blades and interspersed with the plurality of primary cutting elements in a pattern such that as a bit body rotates the secondary ridge structures contact the down hole casing or the earth formation thereby protecting the primary cutting elements and allowing continuous substantially smooth casing milling or earth formation drilling.

The primary cutting elements and the secondary ridge structures are arranged about the bit face to increase element contact during operation, particularly when interrupted cuts are taken while milling a window in steel casing. The secondary ridge structures may be configured in a pattern of full or partial concentric rings or other beneficial shapes. The secondary ridge structures are positioned such that as the bit body rotates, one secondary ridge structure protrusion slides off the steel or rock and another secondary ridge structure protrusion comes in contact, allowing continuous smooth drilling.

In another embodiment of the invention, the secondary ridge structures are mounted adjacent to a primary cutting element to control the cutting depth of the primary cutting element. The leading edge of the secondary ridge structure would be positioned to expose the front face of the primary cutting element. Each secondary ridge structure has a leading edge configuration ramping up to the desired height.

Technical advantages of the mill/drill bit of the present invention include utilizing the same primary cutting elements for both window milling of steel casing and drilling in earth formations of varying hardness. This results in a substantial cost saving by eliminating trip-out and trip-in when boring multiple laterals from the same casing. By use of the secondary ridge structures that allow continuous substantially smooth casing milling or earth formation drilling, there is achieved the technical advantage of reliable window milling in steel casing and improved efficiency in lateral bore hole drilling.

DETAILED DESCRIPTION OF THE DRAWINGS

Figure 1:
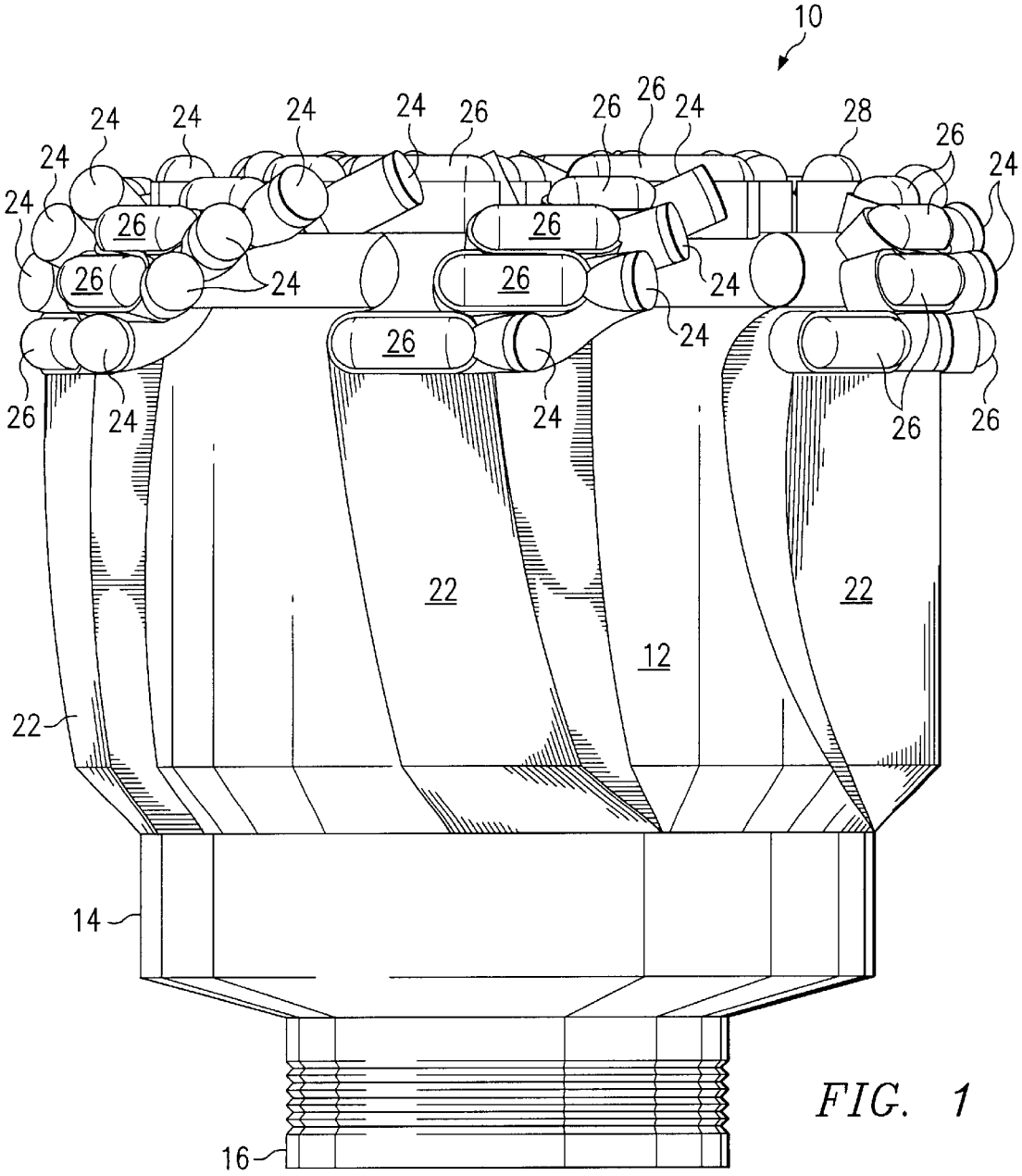
FIG. 1 is a pictorial view of a mill/drill bit in accordance with the present invention.
Figure 2:
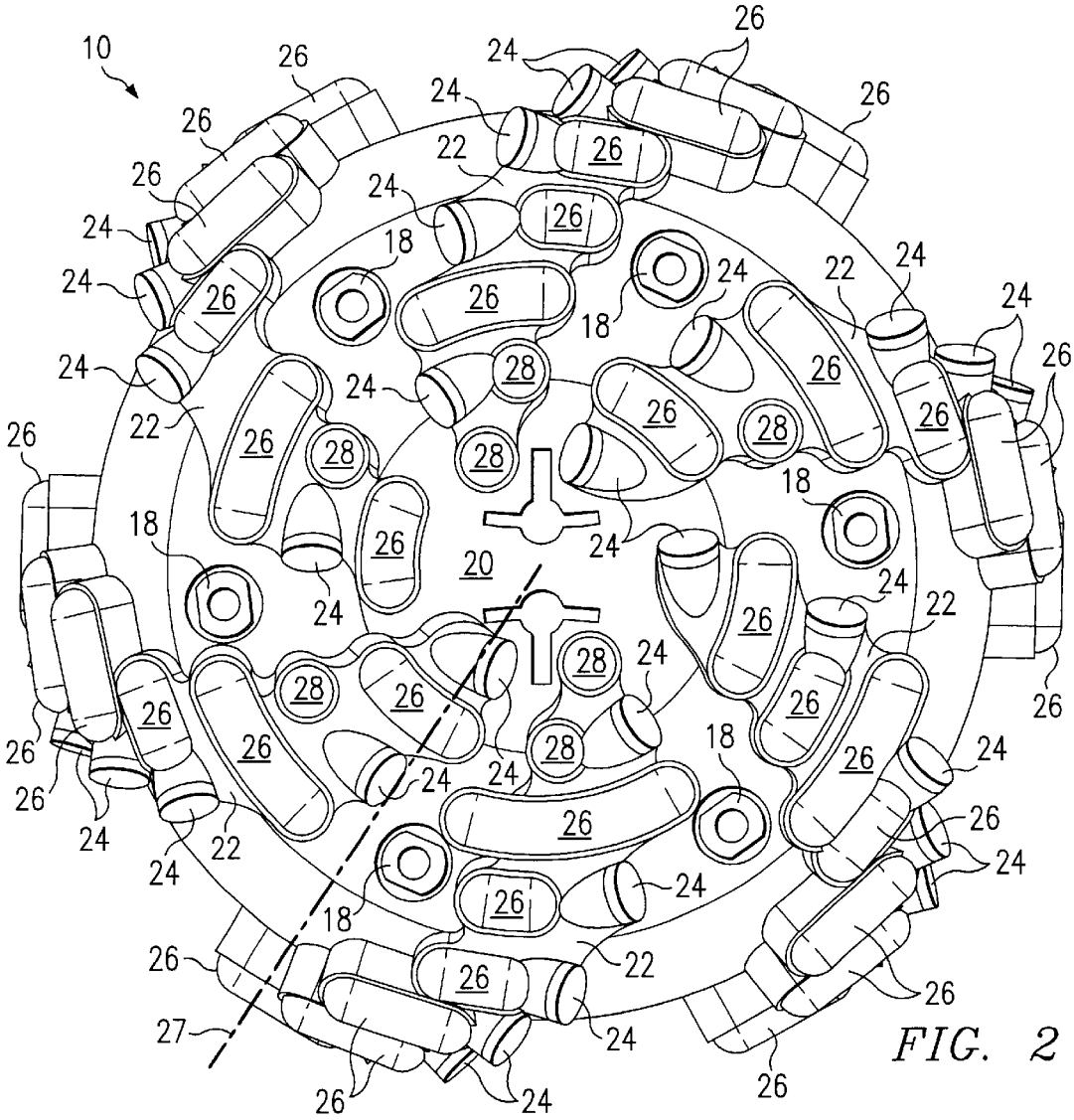
FIG. 2 is an end view of the operating end face of the mill/drill bit of FIG. 1.

Referring to FIGS. 1 and 2, there is shown a mill/drill bit 10 embodying the features of the present invention. As illustrated, the bit 10 has fixed cutters conventionally referred to in the industry as a drag bit. In accordance with the present invention, the fixed cutters also provide milling of windows in steel bore hole casing. Thus, the mill/drill bit 10 is adapted for milling a window in steel casing followed by drilling through earth formations to form lateral bore holes from the windowed casing. The mill/drill bit 10 comprises a bit body 12, a shank 14 and a threaded connection or pin 16 for connecting the mill/drill bit 10 to a sub as a part of a drill string (not shown) in a manner conventional for processes of drilling in the earth's formations.

Bit body 12 includes a central longitudinal bore (not shown) as is conventional with drill bit construction as a passage for drilling fluid to flow through the drill string into the bit body and exit through nozzles 18 arranged in the operating end face 20. Extending from essentially the center of the operating end face 20 are circumferentially spaced blades 22 that extend down the side of a bit body 10 as gage pads to the shank 14. The bit body 10 is formed in a conventional manner utilizing either powdered metal tungsten carbide or steel bodies machined from a steel block.

Attached to each of the blades 22 of the milling/drilling tool of the present invention is a pattern of primary cutting elements 24 for milling through casing and creating a window into surrounding earth formations for lateral drilling. The primary cutting elements are polycrystalline diamond cutting inserts (PDC) or similar relatively hard material for milling the steel casing or boring into rock of earth formations. Intermixed with the primary cutting elements 24 are secondary ridge structures. The secondary ridge structures 26 have a relatively blunt protrusion that contacts the steel casing or the rock formations while the sharp primary cutting elements 24 is performing the milling/drilling operation. The blunt configuration of the secondary ridge structures 26 exhibits sliding contact with the steel casing or the rock formation to control the penetration of the sharp primary cutting structure 24. Thus, the secondary ridge structures 26 protrudes from the operating end face 20 in close proximity to the primary cutting elements 24 and in operation protects the primary cutting elements during the milling/drilling operation by absorbing impacts, limiting the primary cutter engagement, controlling torque, and provide stability.

The primary cutting elements 24 and the secondary ridge structure 26 are arranged about the operating end face 20 to control contact of the primary cutting elements during a milling and/or drilling operation, particularly when interrupted cuts are taken during the milling of a window in steel casing. The secondary ridge structures 26 may be configured as full or partial concentric rings or various other beneficial shapes to achieve the primary function of absorbing impacts. As illustrated in FIGS. 1 and 2 the secondary ridge structures 26 are positioned such that as the bit body 10 rotates, one secondary ridge structure protrusion slides off the steel casing or rock formation and another secondary ridge structure protrusion makes contact thereby protecting the primary cutting elements 24 and allowing substantially continuous window cutting or drilling. For example, reference is made to the radial line 27 for an illustration of a secondary ridge structure 26 protecting a primary cutting element 24.

Additional relatively blunt ridge structures 28 are arranged around the operating end face 20 at various locations to assist in stabilizing the bit operation in the event of a failure of an adjacent primary cutting element 24. The additional blunt ridge structures 28 may typically be cylindrical shaped with a flat cutting surface. Like the primary cutting elements 24 the additional blunt ridge structures 28 are typically constructed from a relatively hard material.

Each of the primary cutting elements 24 are mounted in pockets formed in the blades 22. As best illustrated in FIGS. 3A through 3D, the primary cutting elements 24 are constructed in accordance with conventional methods and each typically includes a base or support 30 inserted into a pocket of a blade 22 and secured within the pocket by brazing or similar conventional techniques. The support 30 is typically a sintered tungsten carbide material usually with a hardness exceeding that of the bit body 10. Integral with the support 30 is a layer 32 of PDC which forms the cutting face of the primary cutting elements 24.

Figure 3A:
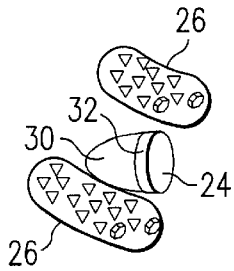
FIGS. 3A, 3B, 3C and 3D illustrate the primary cutting elements and the secondary structure for the mill/drill bit of FIG. 1.
Figure 3B:
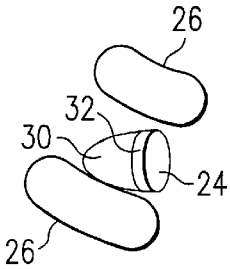
Figure 3C:
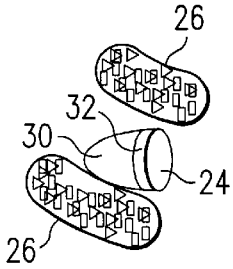
Figure 3D:
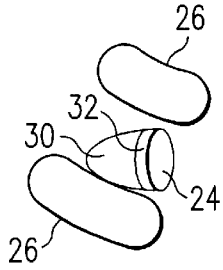

Also as illustrated in FIGS. 3A and 3C, the secondary ridge structures 26 may include crushed carbide cast into the structure surface. The secondary ridge structures 26 may also include TSP or diamond chips. Use of TSP, diamond chips or crushed carbide lessens the wear rate of the secondary ridge structure 26 and also imparts to the structure a secondary cutting operation.

Figure 4:
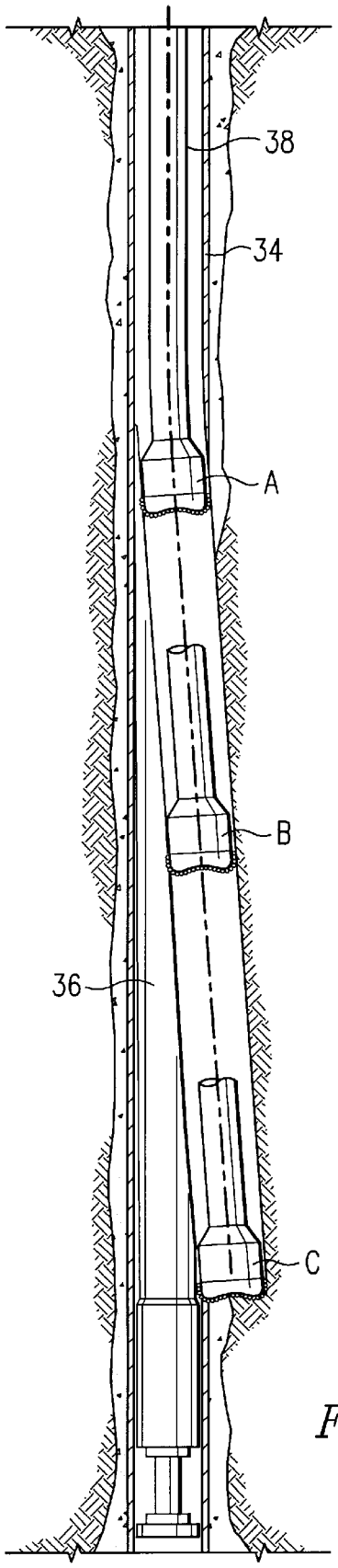
FIG. 4 is an illustration of the mill/drill bit of the present invention cutting a window in a casing.

Referring to FIG. 4, there is illustrated use of the mill/drill bit of the present invention illustrating the sequence of operation of the bit to form a window in a casing 34. The casing is cemented into the bore hole in accordance with accepted practice and a whip stock 36 is run into the hole and oriented such that the concave surface thereof is in the direction of the window to be cut in the casing 34. The whip stock 36 is anchored at a location in the casing 34 for cutting a window.

The mill/drill bit of FIGS. 1 and 2 is attached to a drill string 38 by means of the shank 14. The assembly is rotated in accordance with conventional techniques and as the bit encounters the whip stock 36 the primary cutting elements 24 begin to cut into the casing 36 as shown by the bit in position A. The bit encounters the concave surface of the whip stock 36 and continues cutting into the casing 34 and subsequently into the surrounding cement with the primary cutting elements 24 now cutting the casing 34 and boring through the surrounding cement as illustrated by the bit at position B. As the mill/drill bit of the present invention is nearing completion of the cutting of a window in the casing 34 the primary cutting elements are now boring through the cement surrounding the casing and into the earth formation. Upon completion of the cutting of the window in the casing 36 the mill/drill bit continues to bore into the earth formation and is now functioning primarily as an earth boring bit. Upon completion of the lateral bore hole the assembly including the mill/drill bit of FIGS. 1 and 2 is tripped out of the hole for subsequent use.

Although the present invention has been described by reference to a preferred embodiment, it will be appreciated by those skilled in the art that modifications, substitutions and additions may be made without departing from the scope of the invention as defined in the claims. The embodiment described herein is exemplary only, and is not limiting.

What is claimed is:

1. A drag-type casing mill/drill bit for down hole milling of a casing window and drilling of a bore hole in an earth formation, comprising:

a bit body adapted to be rotated in a defined direction, the bit body having an operating end face;

a plurality of radially extending blades as a part of the operating end face of the bit body, the blades comprising pockets formed therein;

a plurality of primary cutting elements, each element having a cutting face and mounted in a pocket in one of the plurality of blades; and a plurality of secondary ridge structures extending from each of the plurality of blades, each of the secondary ridge structures positioned radially in proximity to at least another one of secondary ridge structures and interspersed with at least one of the plurality of primary cutting elements in a cooperative pattern such that as the bit body rotates at least one of the secondary ridge structures contact the casing or the earth formation thereby limiting the exposure of the cutting face of the primary cutting elements radially positioned from a secondary ridge structure and allowing substantially stable casing milling and earth formation drilling.

2. The drag-type casing mill/drill bit as set forth in claim 1, wherein the secondary ridge structures extending from the plurality of blades comprise a configuration of full or partial concentric rings.

3. The drag-type casing mill/drill bit as set forth in claim 1, wherein the plurality of primary cutting elements comprises a PDC material for penetration into the casing and the earth formation.

4. The drag-type casing mill/drill bit as set forth in claim 1, wherein the plurality of secondary ridge structures comprise an elongated blunt configuration extending from the blades of the bit body to protrude therefrom in close proximity to a primary cutting element and extending from a surface of a blade to substantially the same height as an adjacent primary cutting element.

5. The drag-type casing mill/drill bit as set forth in claim 1, further comprising additional blunt ridge structures mounted to the operating end face of the bit body.

6. The drag-type casing mill/drill bit as set forth in claim 1, wherein the plurality of secondary ridge structures comprise cutting elements embedded in a face of the secondary structure.

7. The drag-type casing mill/drill bit as set forth in claim 6, wherein the cutting elements of the secondary ridge structures comprise a superhard material.

8. A drag-type casing mill/drill bit for down hole milling of a casing window and drilling of a bore hole in an earth formation, comprising:

a bit body adapted to be rotated in a defined direction, the bit body comprising an operating end face having a plurality of pockets formed therein;

a plurality of primary cutting elements, each element having a cutting face and mounted in a pocket in the operating end face; and a plurality of secondary ridge structures extending from the operating end face, each of the secondary ridge structures positioned radially in proximity to at least another one of secondary ridge structures and interspersed with at least one of the plurality of primary cutting elements in a cooperative pattern such that as the bit body rotates at least one of the secondary ridge structures contact the casing or the earth formation thereby limiting the exposure of the cutting face of the primary cutting elements radially positioned from a secondary ridge structure and allowing substantially stable casing milling and earth formation drilling.

9. The drag-type casing mill/drill bit as set forth in claim 8, wherein each of the plurality of primary cutting elements comprises a cutting face oriented in a direction to contact the casing or the earth formation as the bit body rotates in the defined direction.

10. The drag-type casing mill/drill bit as set forth in claim 9, wherein the plurality of primary cutting elements are mounted to the operating end face of the bit body in a random pattern.

11. The drag-type casing mill/drill bit as set forth in claim 8, wherein the plurality of secondary ridge structures comprise an elongated blunt configuration extending from the operating end face of the bit body to protrude therefrom and in close proximity to a primary cutting element and extending from a surface of the operating end face to substantially the same height as an adjacent primary cutting element.

12. The drag-type casing mill/drill bit as set forth in claim 11, wherein the plurality of secondary ridge structures comprise cutting elements embedded in a face of the secondary ridge structure.

13. A drag-type drill bit for down hole drilling of a bore hole in an earth formation, comprising:

a bit body adapted to be rotated in a defined direction, the bit body having an operating end face;

a plurality of radially extending blades as a part of the operating end face of the bit body, the blades comprising pockets formed therein;

a plurality of primary cutting elements, each element having a cutting face and mounted in a pocket in one of the plurality of blades; and a plurality of secondary ridge structures extending from each of the plurality of blades, each of the secondary ridge structures positioned radially in proximity to at least another one of secondary ridge structures and interspersed with at least one of the plurality of primary cutting elements in a cooperative pattern such that as the bit body rotates at least one of the secondary ridge structures contact the earth formation thereby limiting the exposure of the cutting face of the primary cutting elements radially positioned from a secondary ridge structure and allowing substantially stable earth formation drilling.

14. The drag-type drill bit as set forth in claim 13, wherein the secondary ridge structures extending from the plurality of blades comprise a configuration of full or partial concentric rings.

15. The drag-type drill bit as set forth in claim 13, wherein the plurality of primary cutting elements comprises a PDC material for penetration into the earth formation.

16. The drag-type drill bit as set forth in claim 13, wherein the plurality of secondary ridge structures comprise an elongated blunt configuration extending from the blades of the bit body to protrude therefrom in close proximity to a primary cutting element and extending from a surface of a blade to substantially the same height as an adjacent primary cutting element.

17. The drag-type drill bit as set forth in claim 13, further comprising blunt ridge structures mounted to the operating end face of the bit body.

18. The drag-type drill bit as set forth in claim 13, wherein the plurality of secondary ridge structures comprise cutting elements embedded in a face of the secondary structure.

19. The drag-type drill bit as set forth in claim 18, wherein the cutting elements of the secondary ridge structures comprise a superhard material.

20. A drag-type drill bit for down hole drilling of a bore hole in an earth formation, comprising:

a bit body adapted to be rotated in a defined direction, the bit body comprising an operating end face having a plurality of pockets formed therein;

a plurality of primary cutting elements, each element having a cutting face and mounted in a pocket in the operating end face; and a plurality of secondary ridge structures extending from the operating end face, each of the secondary ridge structures positioned radially in proximity to at least another one of secondary ridge structures and interspersed with at least one of the plurality of primary cutting elements in a cooperative pattern such that as the bit body rotates at least one of the secondary ridge structures contact the earth formation thereby limiting the exposure of the cutting face of the primary cutting elements radially positioned from a secondary ridge structure and allowing substantially stable earth formation drilling.

21. The drag-type drill bit as set forth in claim 20, wherein each of the plurality of primary cutting elements comprises a cutting face oriented in a direction to contact the earth formation as the bit body rotates in the defined direction.

22. The drag-type drill bit as set forth in claim 21, wherein the plurality of primary cutting elements are mounted to the operating end face of the bit body in a random pattern.

23. The drag-type drill bit as set forth in claim 20, wherein the plurality of secondary ridge structures comprise an elongated blunt configuration extending from the operating end face of the bit body to protrude therefrom and in close proximity to a primary cutting element and extending from a surface of the operating end face to substantially the same height as an adjacent primary cutting element.

24. The drag-type drill bit as set forth in claim 23, wherein the plurality of secondary ridge structures comprise cutting elements embedded in a face of the secondary ridge structure.

25. A drag-type casing mill/drill bit for down hole milling of a casing window and drilling of a bore hole in an earth formation, comprising:

a bit body adapted to be rotated in a defined direction, the bit body having an operating end face;

a plurality of primary cutting elements, each element having a cutting face and mounted in a pocket in the operating end face; and a plurality of secondary ridge structures extending from the operating end face, each of the secondary ridge structures positioned radially in proximity to at least another one of secondary ridge structures and interspersed with at least one of the plurality of primary cutting elements in a radial plane with at least one of the primary cutting elements such that as the bit body rotates at least one of the secondary ridge structures contact the casing or the earth formation thereby limiting the exposure of the cutting face of the primary cutting elements radially positioned from a secondary ridge structure and allowing substantially stable casing milling and earth formation drilling.

26. The drag-type casing mill/drill bit as set forth in claim 25, wherein the secondary ridge structures extending from the operating end face comprise a configuration of full or partial concentric rings.

27. The drag-type casing mill/drill bit as set forth in claim 25, wherein the plurality of secondary ridge structures comprise an elongated configuration extending from the operating end face of the bit body to protrude therefrom in close proximity to a primary cutting element and extending from a surface of the operating end face to substantially the same height as a primary cutting element in close proximity.

28. The drag-type casing mill/drill bit as set forth in claim 25, wherein the plurality of secondary ridge structures comprise an elongated blunt configuration extending from the operating end face of the bit body to protrude therefrom and in close proximity to a primary cutting element and extending from a surface of the operating end face to substantially the same height as an adjacent primary cutting element.

29. The drag-type drill bit as set forth in claim 25, wherein each of the plurality of secondary ridge structures comprises a leading end trailing a leading end of an adjacent primary cutting element, the leading end defined by direction of rotation of the bit body.

* * * * *